US009677522B2

(12) United States Patent
Ukropec et al.

(10) Patent No.: US 9,677,522 B2
(45) Date of Patent: Jun. 13, 2017

(54) FUEL INJECTOR AND METHOD OF MAKING SAME

(71) Applicant: Ford Global Technologies, LLC, Dearborn, MI (US)

(72) Inventors: Robert Ukropec, Herzogenrath (DE); Oliver Berkemeier, Bergisch Gladbach (DE); Clemens Maria Verpoort, Monheim am Rhein (DE)

(73) Assignee: Ford Global Technologies, LLC, Dearborn, MI (US)

( * ) Notice: Subject to any disclaimer, the term of this patent is extended or adjusted under 35 U.S.C. 154(b) by 544 days.

(21) Appl. No.: 14/333,551

(22) Filed: Jul. 17, 2014

(65) Prior Publication Data

US 2015/0021417 A1 Jan. 22, 2015

(30) Foreign Application Priority Data

Jul. 17, 2013 (DE) ..... 10 2013 213 993

(51) Int. Cl.
*F02D 1/06* (2006.01)
*F02M 61/16* (2006.01)
(Continued)

(52) U.S. Cl.
CPC ..... *F02M 61/166* (2013.01); *C23C 24/082* (2013.01); *C23C 28/04* (2013.01);
(Continued)

(58) Field of Classification Search
CPC ..... F02M 61/16; F02M 61/06; F02M 61/18; F02M 61/166; F02M 61/168;
(Continued)

(56) References Cited

U.S. PATENT DOCUMENTS 6,273,348 B1 * 8/2001 Shouji ..... B05D 5/083 239/585.1
6,489,043 B1 * 12/2002 Deevi ..... B32B 15/011 428/629

(Continued)

*Primary Examiner* — Steven J Ganey
(74) *Attorney, Agent, or Firm* — Damian Porcari

(57) ABSTRACT

The invention relates to a fuel injector (1) for an internal combustion engine. The fuel injector (1) is comprised of an injector body (5) with an injector tip (6). The injector tip (6) is used for the injection of fuel into the combustion chamber (4) of the internal combustion engine. For this reason, the injector tip (6) is designed so as to be at least partially extended into the combustion chamber (4). If the injector tip (6) is designed to be flush with the surface of the combustion chamber (4), the injector tip (6) is arranged so that it directly faces toward the combustion chamber (4). Furthermore, the injector tip (6) is at least partially coated with a first oxide layer (9). According to the invention, a catalytic second oxide coating (10) composed of cerium oxide ($CeO_2$), praseodymium oxide ($PrO_2$), zirconium oxide ($ZrO_2$), or any bi-component combination thereof is applied on top of the first oxide coating (9). The present invention also discloses a method of producing a fuel injector (1) which is at least partially coated with a first oxide coating (9) and a second oxide coating (10) applied over the first oxide coating (9), where the second oxide coating (10) is composed of at least one or more compounds from the group comprising cerium oxide (CeO2), praseodymium oxide (PrO2), or zirconium oxide (ZrO2) and is applied as a washcoat.

15 Claims, 3 Drawing Sheets

(51) Int. Cl.

| | |
|---|---|
| ***F02M 1/18*** | (2006.01) |
| ***F02M 61/06*** | (2006.01) |
| ***C25D 11/02*** | (2006.01) |
| ***C25D 11/04*** | (2006.01) |
| ***C25D 11/24*** | (2006.01) |
| ***C25D 11/26*** | (2006.01) |
| ***C23C 28/04*** | (2006.01) |
| ***C23C 24/08*** | (2006.01) |

(52) U.S. Cl.
CPC ..... *C23C 28/042* (2013.01); *C25D 11/026* (2013.01); *C25D 11/04* (2013.01); *C25D 11/24* (2013.01); *C25D 11/26* (2013.01); *F02M 1/18* (2013.01); *F02M 61/06* (2013.01); *F02M 61/16* (2013.01); *F02M 61/168* (2013.01); *F02M 2200/9038* (2013.01); *Y10S 239/19* (2013.01)

(58) Field of Classification Search
CPC ..... F02M 2200/9038; C23C 24/082; C23C 28/04; C25D 11/026; C25D 11/04; C25D 11/24; C25D 11/26; Y10S 239/19
USPC ..... 239/5, 533.2, 584, 585.1, DIG. 19; 428/629
See application file for complete search history.

(56) References Cited

U.S. PATENT DOCUMENTS 7,051,961 B2 * 5/2006 Mills ..... F02M 51/0682 239/533.2
9,033,256 B2 * 5/2015 Imoehl ..... F02M 61/166 239/533.2

* cited by examiner

FUEL INJECTOR AND METHOD OF MAKING SAME

CROSS REFERENCE TO RELATED APPLICATION

This application claims foreign priority benefits under 35 U.S.C. §119 (1)-(d) to DE 10 2013 213 993.4 Filed Jul. 17, 2013, which are hereby incorporated by reference in their entirety.

FIELD OF THE INVENTION

The present invention relates to a fuel injector for an internal combustion engine, in particular, a fuel injector having its injector tip arranged in a combustion chamber and coated with a first oxide coating, and a second oxide coating over the first oxide coating, where the second oxide coating is composed of at least one or more compounds from the following group comprising cerium oxide (CeO2), praseodymium oxide (PrO2), or zirconium oxide (ZrO2).

BACKGROUND OF THE INVENTION

Internal combustion engines convert the energy contained in a fuel into kinetic energy. An internal combustion engine has at least one combustion chamber in which the fuel is burned. The volume expansion generated during combustion is subsequently converted into rotational motion. To obtain an ignitable and efficient mixture for the combustion process, the fuel is mixed beforehand, with ambient air, in particular with the oxygen ($O_2$) contained therein.

Historically, the desired fuel mixture was provided by a carburetor that was located outside the combustion chamber. Nowadays, injection systems are prevalent. In an injection system, the mixture formation now takes place almost exclusively within the combustion chamber. In direct injection, which is utilized here, a fuel injector injects precisely dosed quantities of fuel into the air-filled combustion chamber. The fuel atomizes when injected and is combined with the air in the combustion chamber. By utilizing this process, low emission, reliable combustion is achieved. Internal combustion engines may be divided into applied-ignition engines and auto-ignition engines. Otto-cycle engines are applied-ignition engines, whereas diesel engines are categorized as auto-ignition engines. In Otto-cycle engines, the mixture situated in the combustion chamber is first compressed and then ignited. This combustion is often accomplished by means of an ignition plug. In diesel engines, the air in the combustion chamber is compressed, rapidly increasing its temperature. The temperature generated in this process is sufficient to initiate auto-ignition of the diesel fuel that is subsequently injected into the compressed combustion chamber.

Besides using fuel in liquid form, such as gasoline, diesel, liquefied gas (Autogas, LPG) or liquefied natural gas (LNG), gas phase fuels are also used. Common examples of gas phase fuels in use are compressed natural gas (CNG) and hydrogen ($H_2$). Further alternative fuels such as ethanol ($C_2H_6O$) or methanol ($CH_4O$) may also be used.

Since the fuel injector must introduce the fuel directly into the combustion chamber, the fuel injector's tip is directly exposed to the heat generated during the combustion process. The injector tip is either partially located within the combustion chamber, or directly facing it. In this installation position, the injector tip must withstand not only the high combustion temperatures, but also temperature shocks and high injection pressures. The effects of corrosive combustion products formed must also be taken into consideration. These corrosive products play a significant role when using alternative fuels.

A fuel injector must maintain reliable operation independent of the driving cycle, driving performance of the vehicle, the respective climatic condition, and the fuel used. It is therefore commonplace for a rust-resistant austenitic steel to be used as a suitable material for the highly loaded fuel injector.

After a certain period of operation, some combustion products, such as soot or oil carbons, have been found deposited on the fuel injector. Such deposits form earlier and more readily on a passivation, protective layer composed of chromium oxide (Cr2O3) than on a surface composed of copper (Cu) or brass (CuZn).

Prior art suggests that the fuel injector should be coated with a suitable material in order to minimize or prevent these depositions from forming.

Accordingly, DE 199 51 014 A1 discloses a direct fuel injector which releases fuels, such as gasoline or diesel, into the combustion chamber of an internal combustion engine. The fuel injector has, for this purpose, an injector tip with at least one outlet opening for the fuel. A coating is suggested in order to maintain the spray parameters and prevent the tip from being adversely altered by the deposition of fuel and soot particles.

The coatings are formed from three groups of proposed materials, with each group having specific properties of interest. The first group consists of cobalt or nickel oxides, and oxides of alloys of the stated metals. These oxides are intended to prevent both the catalytic conversion (combustion) of soot particles that have already been deposited and the further deposition of carbon particles. This group also includes noble metals such as ruthenium (Ru), rhodium (Rh), palladium (Pd), osmium (Os), iridium (Ir), platinum (Pt), and alloys of these metals with one another or with other metals. The second group of metals is intended to change the wetting behavior on the surface of the fuel injector so that the fuel droplets form beads and can be entrained by the surrounding flow. This second group includes ceramic coatings, metal-containing or metal-free carbon coatings, and fluorine-containing coatings or sapphire coatings. The third and final group is comprised of nitrite coatings, such as titanium nitride (TiN) or chromium nitride (CrN), and of oxide coatings (eg. tantalum oxide, TaO, or titanium oxide, TiO). This third group's purpose is to prevent the formation of a reaction layer on the fuel injector.

DE 42 22 137 B4 describes a fuel injection nozzle that can be used in diesel internal combustion engines. The fuel injector has a tip with at least one spray hole. In order to fabricate a spray hole with a cross sectional area that cannot be formed using conventional production methods, a coating is provided that extends into the spray hole. This reduces the effective cross section of the spray hole, which narrows in frustoconical form toward the outlet side. To apply the coating, the use of a hard material is proposed. For example, chromium (Cr), nickel (Ni), nickel-phosphorus, nickel-boron, nickel-cobalt-boron, aluminum oxide ($Al_2O_3$), chromium oxide ($Cr_2O_3$), titanium oxide ($TiO_2$), chromium carbide ($Cr_3C_2$), silicon dioxide ($SiO_2$), (AlSi), (NiCr), (WTi) or (WC) will suffice.

In order to prevent deposits from forming on a fuel injector for an internal combustion engine, JP 2007-309167

A proposes that the surface of the fuel injector be coated around an injection hole. Titanium oxide (TiO) is proposed as a photocatalytic coating.

JP 2005-155618 A discloses a method for the formation of a uniform coating, composed of titanium oxide (TiO), on an injection nozzle of a fuel injector for an internal combustion engine. This coating is applied in order to prevent, or at least reduce, any enrichment of carbon deposits. It is proposed that at least one section of the injection nozzle is initially dipped into a film-forming, undiluted solution of titanium ammonium fluoride ($(NH_4)_2TiF_6$) and boric acid ($H_3BO_3$). Titanium oxide (TiO) is subsequently deposited on the surface of a valve seat and on the inner side of the injector tip in order to form a titanium oxide coating.

According to the cited teaching, the aim is to reduce the enrichment of deposits on the injector tips of fuel injectors. It is important to maintain the structural spray characteristics of the outlet openings for as long as possible. Hitherto, consideration has not been given to the emissions-related disadvantages that likewise arise from these soot deposits. With continuous use, uncontrolled combustion of fuel residue thickens the soot layer, and causes an increase in the emission of volatile organic substances (HC emissions). These residues are then ignited in an undesired manner by means of the fuel injector, whose lining covered tip continues to exhibit afterglow at the end of a combustion cycle, in a similar manner to a glow plug.

Even though it has already been possible to achieve a reduction of deposits by means of the coatings proposed in the prior art, the design of the fuel injector in question still offers room for improvement. In particular, it offers improvement with regard to the emissions generated by uncontrolled combustion events.

SUMMARY OF THE INVENTION

This invention improves a fuel injector for an internal combustion engine of a motor vehicle so that the emissions of volatile organic substances (HC emissions) due to the combustion of fuel are greatly reduced. It also specifies a method for producing a fuel injector which, during operation, permanently exhibits reduced emissions, and in particular, displays permanently reduced emissions of volatile organic substances (HC emissions).

The present invention relates to a fuel injector for an internal combustion engine, in particular, a fuel injector having an injector tip arranged in a combustion chamber and coated with a first oxide coating, and a second oxide coating over the first oxide coating, where the second oxide coating is composed of at least one or more compounds from the following group comprising cerium oxide (CeO2), praseodymium oxide (PrO2), or zirconium oxide (ZrO2).

The present invention also discloses a method of producing a fuel injector which is at least partially coated with a first oxide coating and a second oxide coating applied over the first oxide coating, where the second oxide coating is composed of at least one or more compounds from the group comprising cerium oxide (CeO2), praseodymium oxide (PrO2), or zirconium oxide (ZrO2).

It is pointed out that the features and measures specified individually in the following description may be combined with one another in any desired technically meaningful way and discloses further refinements of the invention. The description, in conjunction with the figures, characterizes and specifies the invention further.

A fuel injector for an internal combustion engine is disclosed. The fuel injector is comprised of an injector body with an injector tip. The injector tip is used for the injection of fuel into the combustion chamber of the internal combustion engine. For this reason, the injector tip is designed so as to be at least partially extended into the combustion chamber. If the injector tip is designed to be flush with the surface of the combustion chamber, the injector tip is arranged so that it directly faces toward the combustion chamber. Furthermore, the injector tip is at least partially coated with the first oxide layer.

According to the invention, a catalytic second oxide coating composed of cerium oxide ($CeO_2$), praseodymium oxide ($PrO_2$), zirconium oxide ($ZrO_2$), or any bi-component combination thereof is applied on top of the first oxide coating.

The particular advantage of the oxide compounds is their strong ability to store oxygen ($O_2$). These compounds, either alone or in combination with one another, bring about a reduction in the light-off temperature of the fuel, unburned hydrocarbons (CH), and carbon monoxide (CO). By accomplishing this, the emissions of the internal combustion engine during operation can be reduced.

Further development shows that it is advantageous to use titanium oxide ($TiO_2$) or aluminum oxide ($Al_2O_3$) to form the first oxide coating. The ideal substrate for the second catalytic oxide coating is composed of titanium (Ti) and/or a porous ceramic layer of aluminum oxide. In this case, the first oxide coating has a preferable thickness of 10.0 to 20.0 μm.

Aluminum oxide ($Al_2O_3$) in particular is an excellent substrate material for catalysts due to its high temperature resistance, its large surface area, its advantageous acid-base properties, and its ability to interact with other metals.

When discussing fuel injectors, it is considered to be advantageous for the first oxide coating to be impregnated with copper oxide (CuO). It is also possible for either the second or both the first and second oxide coatings to be impregnated with copper oxide as well. The advantage of impregnating the coating with copper oxide (CuO) is the further reduction of the light-off temperature of combustible constituents. This reduction leads to the elimination, or reduction to the point of prevention, of deposits on the coated injector tip. The injector tip catalyst is composed of cerium oxide ($CeO_2$) and copper oxide (CuO) or praseodymium oxide ($PrO_2$) and copper oxide (CuO).

In conjunction with the advantages associated with an impregnation of the first and/or second oxide coating, it is provided that the first and/or second oxide coating may also be impregnated with platinum (Pt) and/or a further element from the platinum group metals. Aside from platinum (Pt), the platinum group metals are ruthenium (Ru), osmium (Os), rhodium (Rh), iridium (Ir), and palladium (Pd). The advantage of impregnating the coating with one or more of the above-mentioned elements is the elimination, or reduction to the point of prevention, of deposits on the coated injector tip and a reduction of the light-off temperature of combustible constituents.

As a particularly advantageous embodiment, it is proposed that at minimum the injector tip of the fuel injector is at least partially formed from a powder metallurgical Al—Si material (PEAK S250). The Al—Si material from the manufacturer PEAK ($AlSi_{20}Fe_5Ni_2$) exhibits extremely high strength and rigidity in relation to conventional aluminum alloys. Aside from the already low weight of the aluminum material, PEAK 5250 is able to achieve tensile strengths of up to 750 $N/mm^2$. The silicon particles precipitate on the surface and form a naturally hard, uniform coating with a thickness of 4.0 to 5.0 μm. When at least partially formed from 5250, the injector tip exhibits high wear resistance even without a coating. This material also displays high heat resistance and superior machinability. The required outlet openings of the injector tip can be formed without deburring. The aluminum material ($AlSi_{20}Fe_5Ni_2$) used for the injector tip also serves as a substrate for the applied coatings described in the invention.

As an alternative to the use of the powder metallurgical Al—Si material (PEAK S250), the injector tip may instead be at least partially formed from a titanium alloy (Ti6Al4V). Although this may be the case, the required outlet openings are more difficult to machine in titanium alloy than PEAK 5250 and the second oxide coating, composed of cerium oxide ($CeO_2$), is less effective when applied to the titanium alloy than the Al—Si material.

The present invention presents a fuel injector which is an improvement of the prior art in the region of its tip. The injector tip's surface, according to the invention, prevents the deposition of liquid fuel in the form of droplets, which would otherwise dry onto the surface of the injector tip. After a period of time, the droplets leave behind tar and/or carbon linings which cannot readily be removed. Such linings have an adverse effect on the emissions of the internal combustion engine during the operation thereof. The injector tip's coating behaves as a catalyst which facilitates the evaporation of fuel droplets and prevents the formation of a lining.

Also presented within the context of the invention is a method by which an improved fuel injector for an internal combustion engine, as specified above, can be produced. The fuel injector is comprised of an injector body with an injector tip. The injector tip is designed to be partially located within the combustion engine, or at least directly facing toward the combustion chamber of the internal combustion engine. The injector tip is at least partially coated with a first oxide coating.

According to the invention, a second oxide coating is then applied, as a washcoat, over the first oxide coating. The second oxide coating may also be composed of praseodymium oxide ($PrO_2$), zirconium oxide ($ZrO_2$), cerium oxide ($CeO_2$), or any bi-component combination of the mentioned oxides.

The advantages associated with the use of the abovementioned compounds and the advantages associated with the measures described below have already been explained above, and applied correspondingly to the method of producing a fuel injector of the type.

In order for one or more of the compounds to be applied, in the form of a second oxide coating, as a washcoat to the first oxide coating of the injector tip, the washcoat is initially present in the form of a powder suspension. The powder suspension is subsequently, for example in the form of an aqueous suspension, applied to the injector tip that has already been coated with the first oxide coating. By means of subsequent calcination, the suspension thus applied is activated.

In refinements of the method, the first oxide coating may be formed from titanium oxide ($TiO_2$) or aluminum oxide ($Al_2O_3$). It is preferable for the first oxide coating to be at least partially applied on the injector tip with a thickness of 10.0 to 20.0 μm.

The first oxide coating may be applied to the injector tip by means of a micro arc oxidation (MAO) process or a plasma electrolytic oxidation (PEO) process. By using an MAO process, the injector tip is improved in that, inter alia, the hardness and wear-resistance of the surface are increased. This is also true for the PEO process, in which the surface of the injector tip is transformed by a plasma discharge. By means of the stated methods, the first oxide coating is advantageously transformed into a dense, atomically adherent ceramic layer.

It is possible for the first, second or both coatings to be impregnated with copper oxide (CuO), and is traditionally considered advantageous for the first to be impregnated.

In conjunction with the advantages associated with an impregnation of the first and/or second oxide coating with copper oxide (CuO), the first and/or the second oxide coatings may also be impregnated with platinum (Pt) and/or a further element from the platinum group metals. Aside from platinum (Pt), the platinum group metals are in particular ruthenium (Ru), osmium (Os), rhodium (Rh), iridium (Ir), and palladium (Pd).

As a particularly advantageous embodiment, it is proposed that at minimum the injector tip of the fuel injector is at least partially formed from a powder metallurgical Al—Si material (PEAK S250). The Osprey method for spray compaction is proposed as a suitable method for the production thereof. In one type of the Osprey method that can be utilized here, the melt of the Al—Si material is applied by way of a nozzle to a cooled copper plate. The spray-compacted studs thus formed are subsequently extruded to form rods or pipes.

Alternatively, aluminum, for example PLM908 from Powder Light Metals, may be used as it is resistant to high temperatures. Thus, even higher hot tensile strengths are achieved due to the increased rate of cooling. The increased rate of cooling occurs when liquid aluminum droplets are cast onto a fast-rotating, cooled copper wheel. The aluminum ribbons thus formed are subsequently compacted and extruded in order to produce semifinished products. The melt is cooled at such a rate that it immediately solidifies and is spun off by the high rotational speed of the copper wheel. The method is advantageous in that it produces a preferred microstructure for the injector tip.

The Al—Si material from the manufacturer PEAK ($AlSi_{20}Fe_5Ni_2$) exhibits extremely high strength and rigidity in relation to conventional aluminum alloys.

As an alternative to the use of the powder metallurgical Al—Si material (PEAK S250), the injector tip may be partially formed from a titanium alloy ($Ti_6Al_4V$). The melt spinning process explained above is a suitable method proposed for the production thereof.

Further advantageous details and effects of the invention will be explained in more detail below on the basis of various exemplary embodiments illustrated in the figures.

DETAILED DESCRIPTION OF THE PREFERRED EMBODIMENTS

Figure 1:
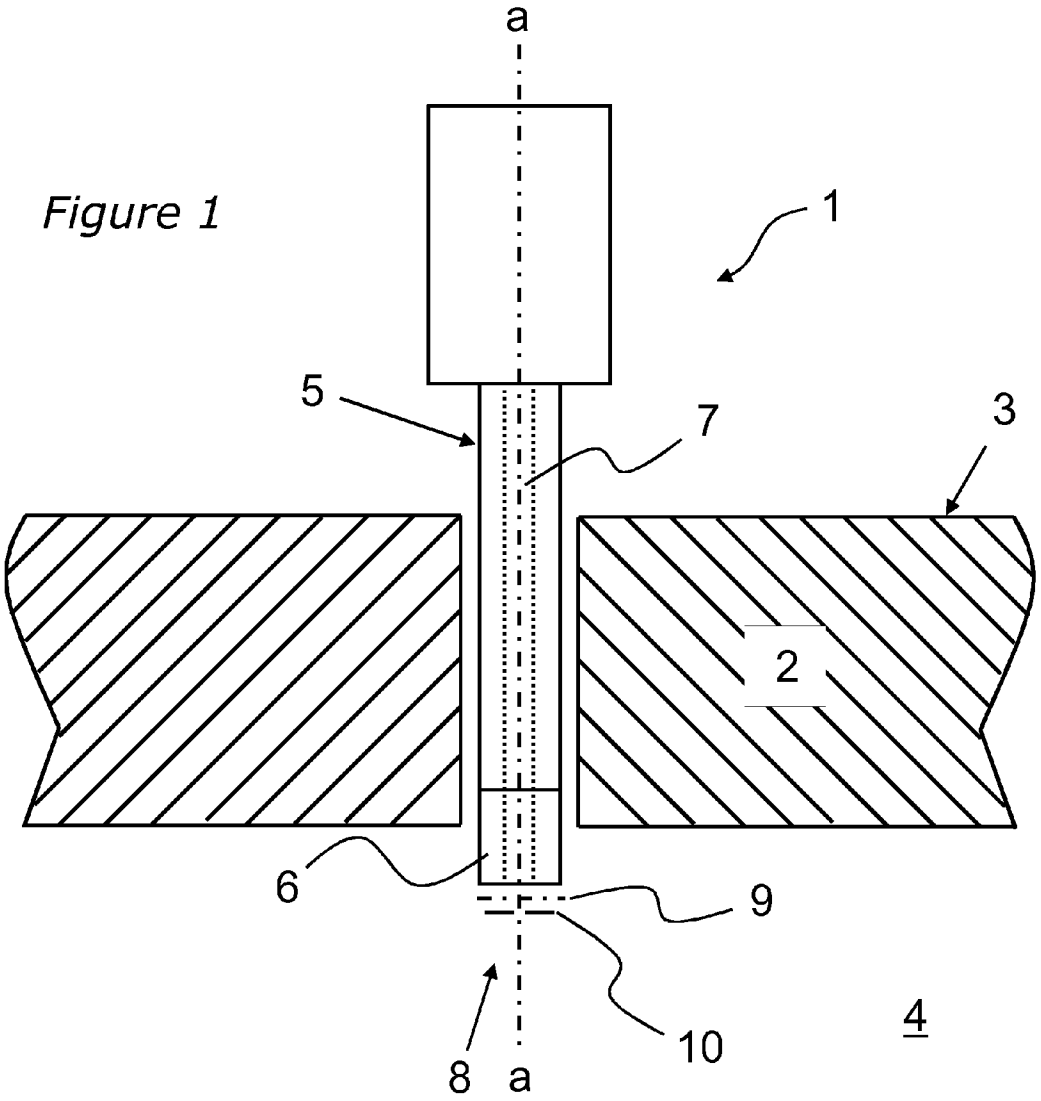
FIG. 1 is a schematic illustration of a fuel injector according to the invention in a side view.

FIG. 1 shows a schematic illustration of a fuel injector (1) according to the invention. The fuel injector (1) is provided for use in an internal combustion engine (not illustrated in any more detail). Also indicated is a section of a wall (2) of a cylinder head (3) of the internal combustion engine (not shown in any more detail), through which the fuel injector (1) is arranged. A sub-region of the fuel injector (1) extends into a combustion chamber (4) of the internal combustion engine.

The fuel injector (1) is comprised substantially of a fuel injector body (5). The section of the fuel injector's body (5) which faces toward the combustion chamber (4), and is located partially in the combustion chamber, has an injector tip (6). The injector tip (6) is at least partially formed from a powder metallurgical Al—Si material (PEAK 5250) or from a titanium alloy ($Ti_6Al_4V$). The dotted lines running in a longitudinal direction (a) of the fuel injector (1) serve for illustrating a duct (7) within the fuel injector (1). A fuel (not shown in any more detail) can be injected by means of the fuel injector (1) into the combustion chamber (4) through the duct (7).

In the present invention, at least one face side (8) of the injector tip (6) is provided, as indicated, with a first oxide coating (9) and with a second oxide coating (10) arranged on top of the first oxide coating (9). The first oxide coating (9) is formed from titanium oxide ($TiO_2$) and/or aluminum oxide ($Al_2O_3$). By contrast, the second oxide coating is applied as a wash coat and is composed of cerium oxide ($CeO_2$), praseodymium oxide ($PrO_2$), zirconium oxide ($ZrO_2$), or any bi-component combination thereof.

Furthermore, the first oxide coating (9) and/or the second oxide coating (10) are impregnated, in a manner not shown in any more detail, with copper oxide (CuO). A further impregnation of the first oxide coating (9) and/or the second oxide coating (10) with at least one or more elements (likewise not illustrated in any more detail) from the platinum group metals is likewise provided. The platinum group is composed of ruthenium (Ru), osmium (Os), rhodium (Rh), iridium (Ir), palladium (Pd) and platinum (Pt).

Figure 2:
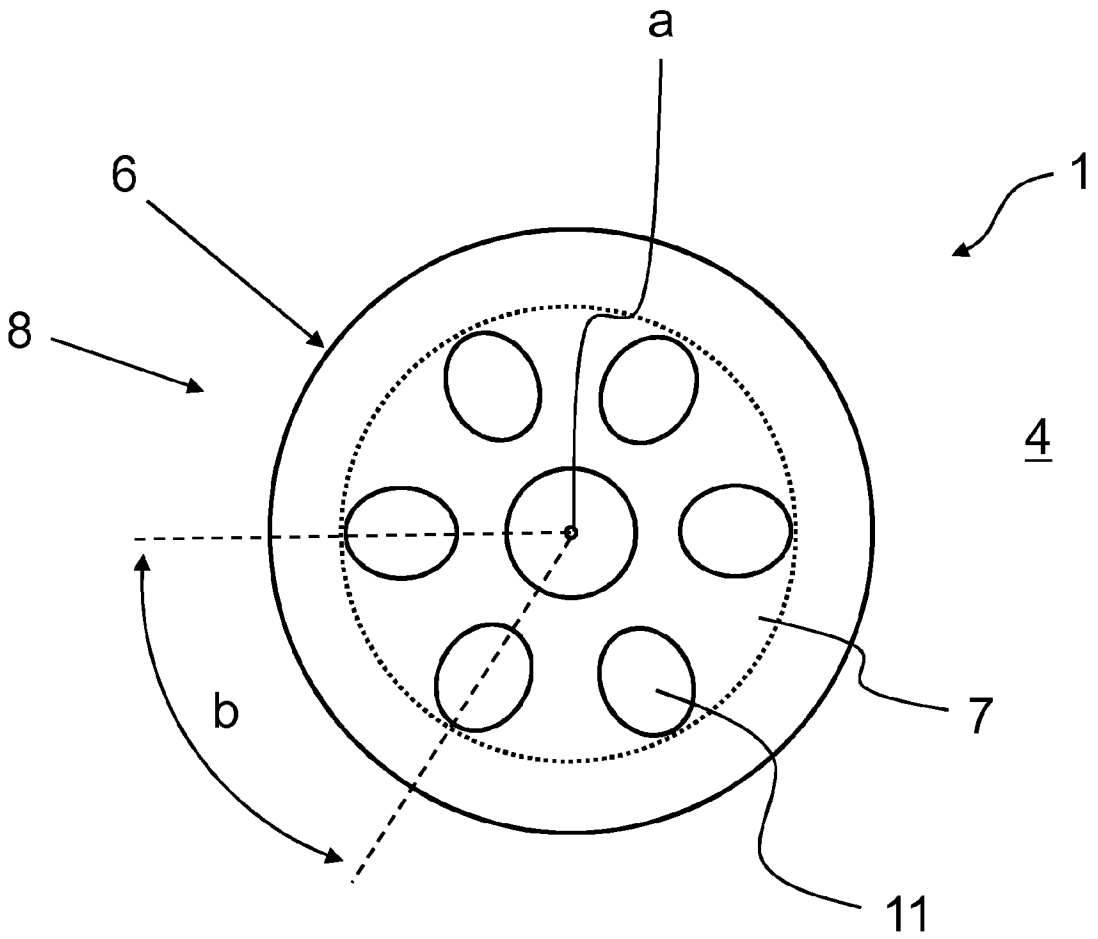
FIG. 2 shows the fuel injector from FIG. 1, in a view of the end-side injector tip thereof.

FIG. 2 shows the fuel injector (1) from FIG. 1, in a view of the face side (8) of the injector tip (6). To make the present view in the longitudinal direction (a) of the fuel injector (1) as clear as possible, the wall (2) of the cylinder head (3) and the region of the fuel injector (1) which is situated outside the combustion chamber (4) in FIG. 1 are not indicated.

As can be seen, the injector tip (6) has multiple outlet openings (11) from which the fuel can enter the combustion chamber (4) in a manner not illustrated in any more detail. Six outlet openings (11) are distributed about the central longitudinal axis (a) of the fuel injector (1), so as to be at the same radial distance from the longitudinal axis. These outlet openings are all equidistant from one another, so as to be arranged offset with respect to one another by the same angle (b).

Figure 3:
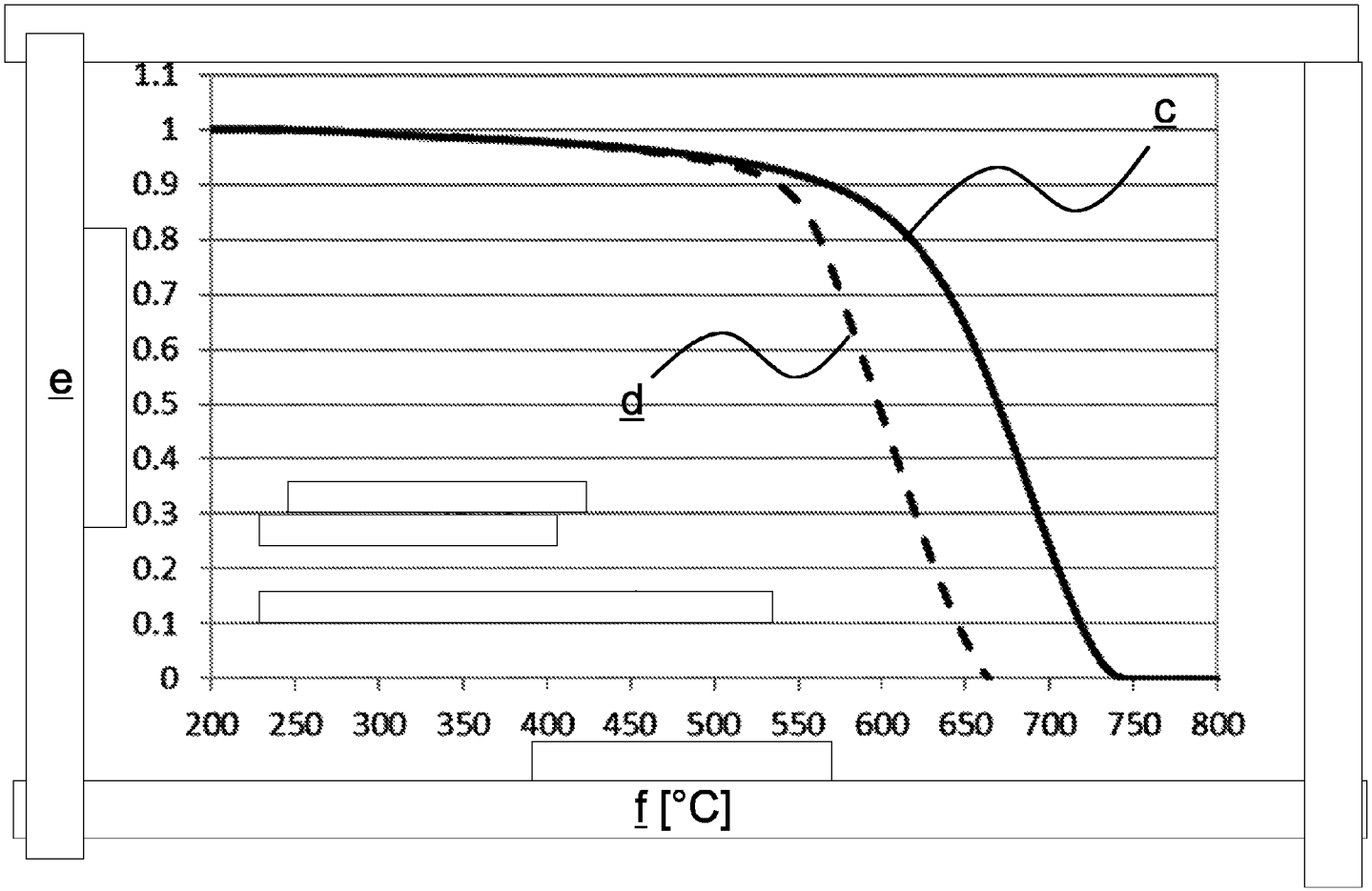
FIG. 3 shows a diagram illustrating the weight of soot in relation to its different oxidation temperatures on an uncoated injection tip, and on a coated injection tip of the fuel injector from FIGS. 1 and 2.

FIG. 3 shows a diagram of test results. Two curves (c), (d) are shown within the diagram. The two curves (c), (d) depict the weight (e) of soot deposited on the injector tip (6) in relation to the initial starting weight of soot. The soot is oxidized over time, such that the weight (e) thereof decreases. The curves (c), (d) of FIG. 3 are plotted versus a temperature (f) in ° C. The first curve (c), shown by a solid line, shows the measurement results for a normal, uncoated injector tip (6). The remaining curve (d), shown by a dashed line, illustrates the measurement results for an injector tip (6) coated and impregnated according to the invention.

The present diagram serves for illustrating the improved combustion of soot on an injector tip (6) that is coated with a catalytic second oxide coating (10) composed of cerium oxide ($CeO_2$) and praseodymium oxide ($PrO_2$). The injector tip (6) was formed from the aluminum material $AlSi_{20}Fe_5Ni_2$ and was coated with the first oxide coating (9) and a second oxide coating (10) which was composed of cerium oxide ($CeO_2$) and praseodymium oxide ($PrO_2$) and impregnated with copper oxide (CuO). The copper oxide (CuO) is preferably embedded only in the second oxide coating (10).

The soot shown in the first curve (c) is a synthetic soot which is more stable than diesel and gasoline soot and which burns at higher temperatures. The oxide catalyst coating comprised of cerium oxide ($CeO_2$), praseodymium oxide ($PrO_2$) and copper oxide (CuO) was able to lower the combustion temperature of the synthetic soot by 70° C. Seeing as this is resistant synthetic soot, the combustion temperature will most likely be even lower when using naturally produced soot.

The plotted measurement results in FIG. 3 were obtained using a thermogravimetric analysis (TGA) unit to test the combustion of synthetic soot in a laboratory. The synthetic soot used was produced by Hiden, UK with a quartz tube. For these tests, approximately 40.0 milligrams of soot were mixed with 120.0 milligrams of silicon carbide (SiC) as well as a catalyst. The injector tip thus prepared was placed into the basket of the thermogravimetric analysis (TGA) unit in an atmosphere containing 8% oxygen ($O_2$). The sample was subsequently heated to 800° C. with a temperature rise of 10° C. per minute. The gases generated during the reaction were measured by a mass spectrometer.

LIST OF REFERENCE SIGNS

1 Injection valve
2 Wall of 3
3 Cylinder head
4 Combustion chamber
5 Valve body of 1
6 Valve head of 1
7 Duct in 1
8 Face side of 6
9 First oxide coating
10 Second oxide coating
11 Outlet opening in 6
a Longitudinal direction of 1
b Angle between 11
c First curve in diagram
d Second curve in diagram
e Weight of soot in relation to initial weight in diagram
f Temperature in diagram

What is claimed:

1. A fuel injector having a tip comprising:
a first oxide coating, and
a second oxide wash coating on top of the first oxide coating, the second oxide selected from the group consisting of cerium oxide (CeO2), praseodymium oxide (PrO2), zirconium oxide (ZrO2), or any bi-component combination thereof.

2. The fuel injector of claim 1, the first oxide coating further comprising impregnated copper oxide (CuO).

3. The fuel injector of claim 1, the second oxide coating further comprising impregnated copper oxide (CuO).

4. The fuel injector of claim 1, the first oxide further comprising a platinum group metal catalyst selected from the group consisting of ruthenium (Ru), osmium (Os), rhodium (Rh), iridium (Ir), palladium (Pd) or platinum (Pt).

5. The fuel injector of claim 1, the second oxide further comprising a platinum group metal catalyst selected from the group consisting of ruthenium (Ru), osmium (Os), rhodium (Rh), iridium (Ir), palladium (Pd) or platinum (Pt).

6. The fuel injector of claim 1, wherein the first oxide coating is selected from the group consisting of titanium oxide (TiO2), aluminum oxide (Al2O3) or mixtures thereof.

7. The fuel injector of claim 1, wherein the tip is at least partially from a powder metallurgical Al—Si material or from a titanium alloy.

8. A method for producing a fuel injector comprising:

applying a first oxide coating to said injector; and applying a second oxide coating over the first oxide coating, the second oxide coating composed of at least one or more compounds from the group consisting of cerium oxide (CeO2), praseodymium oxide (PrO2), or zirconium oxide (ZrO2).

9. The method of claim 8, further comprising impregnating copper oxide (CuO) in the first oxide coating.

10. The method of claim 8, further comprising impregnating copper oxide (CuO) in the second oxide coating.

11. The method of claim 8, wherein the first oxide coating further comprising a platinum group metal catalyst selected from the group consisting of ruthenium (Ru), osmium (Os), rhodium (Rh), iridium (Ir), palladium (Pd) or platinum (Pt).

12. The method of claim 8, wherein the second oxide coating further comprising a platinum group metal catalyst selected from the group consisting of ruthenium (Ru), osmium (Os), rhodium (Rh), iridium (Ir), palladium (Pd) or platinum (Pt).

13. The method of claim 8, wherein the first oxide coating is selected from the group consisting of titanium oxide (TiO2), aluminum oxide (Al2O3) or mixtures thereof.

14. The method of claim 8, wherein the tip is at least partially from a powder metallurgical Al—Si material or from a titanium alloy.

15. The method of claim 14, wherein the tip is at least partially from a powder metallurgical Al—Si material (PEAK 5250) or from a titanium alloy ($Ti_6Al_4V$) by melt spinning.

* * * * *